US011519679B2

(12) United States Patent
Joardar

(10) Patent No.: US 11,519,679 B2
(45) Date of Patent: Dec. 6, 2022

(54) VORTEX-ENHANCED HEAT EXCHANGER

(71) Applicant: Carrier Corporation, Palm Beach Gardens, FL (US)

(72) Inventor: Arindom Joardar, Jamesville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 95 days.

(21) Appl. No.: 16/972,203

(22) PCT Filed: Sep. 4, 2020

(86) PCT No.: PCT/US2020/049350

§ 371 (c)(1),
(2) Date: Dec. 4, 2020

(87) PCT Pub. No.: WO2021/046314

PCT Pub. Date: Mar. 11, 2021

(65) Prior Publication Data

US 2021/0148657 A1 May 20, 2021

Related U.S. Application Data

(60) Provisional application No. 62/896,131, filed on Sep. 5, 2019.

(51) Int. Cl.
*F25B 39/04* (2006.01)
*F28F 13/12* (2006.01)
(Continued)

(52) U.S. Cl.
CPC ..... *F28F 13/12* (2013.01); *F25B 39/00* (2013.01); *F28F 1/325* (2013.01); *F28F 2215/10* (2013.01)

(58) Field of Classification Search
CPC .... F28F 13/12; F28F 3/02; F28F 1/325; F28F 2215/10; F28F 2215/08; F25B 39/00
(Continued)

(56) References Cited

U.S. PATENT DOCUMENTS 6,578,627 B1 6/2003 Liu et al.
10,578,375 B2 * 3/2020 Wang ..... F28F 1/325
(Continued)

FOREIGN PATENT DOCUMENTS

JP S63294494 A 12/1988
WO 2019118872 A1 6/2019

OTHER PUBLICATIONS

International Search Report for International Application No. PCT/US2020/049350; International Filing Date: Sep. 4, 2020; dated Nov. 19, 2020, 11 pages.

(Continued)

*Primary Examiner* — Len Tran
*Assistant Examiner* — Kamran Tavakoldavani
(74) *Attorney, Agent, or Firm* — Cantor Colburn LLP

(57) ABSTRACT

A tube and fin heat exchanger includes a plurality of heat exchange tubes configured for flowing a refrigerant therethrough, a plurality of fins positioned such that the plurality of heat exchange tubes pass through a plurality of tube openings in the plurality of fins, and a plurality of vortex generators extending from a fin surface of the plurality of fins. The plurality of vortex generators are arranged to define nozzle like passages at the heat exchange tubes.

18 Claims, 9 Drawing Sheets

(51) Int. Cl.
*F25B 39/00* (2006.01)
*F28F 1/32* (2006.01)

(58) Field of Classification Search
USPC ..... 62/507
See application file for complete search history.

(56) References Cited

U.S. PATENT DOCUMENTS

| | | | | |
|---|---|---|---|---|
| 2004/0194936 | A1* | 10/2004 | Torii | F28F 1/325 165/181 |
| 2007/0246206 | A1 | 10/2007 | Gong et al. | |
| 2009/0014159 | A1 | 1/2009 | Nishino et al. | |
| 2021/0285700 | A1* | 9/2021 | Brillhart | F25B 25/02 |

OTHER PUBLICATIONS

Written Opinion for International Application No. PCT/US2020/049350; International Filing Date: Sep. 4, 2020; dated Nov. 19, 2020, 8 pages.

* cited by examiner

VORTEX-ENHANCED HEAT EXCHANGER

CROSS REFERENCE TO RELATED APPLICATIONS

This application is a National Stage application of PCT/US2020/049350, filed Sep. 4, 2020, which claims the benefit of Provisional Application No. 62/896,131 filed Sep. 5, 2019, the disclosures of which are incorporated herein by reference in their entirety.

BACKGROUND

Exemplary embodiments pertain to the art of heating, ventilation, air conditioning and refrigeration (HVAC&R) systems. More particularly, the present disclosure relates to configurations of tube and fin heat exchangers for HVAC&R systems.

Currently, many HVAC&R systems utilize round-tube plate-fin (RTPF) heat exchangers in their evaporator sections. Due to frosting and other design considerations, these heat exchangers typically utilize rudimentary fin designs without enhancements to improve thermal energy exchange performance and efficiency, and thus need large fin surface areas to meet the performance requirements.

In general, such evaporators need large flow depths to manage exit air temperature and are overtly large, are excessively heavy and higher cost. Most common fin enhancement strategies requiring surface interruptions such as lances and louver geometries are rendered ineffective under frosting conditions due to blockage.

BRIEF DESCRIPTION

In one embodiment, a tube and fin heat exchanger includes a plurality of heat exchange tubes configured for flowing a refrigerant therethrough, a plurality of fins positioned such that the plurality of heat exchange tubes pass through a plurality of tube openings in the plurality of fins, and a plurality of vortex generators extending from a fin surface of the plurality of fins. The plurality of vortex generators are arranged to define nozzle like passages at the heat exchange tubes.

Additionally or alternatively, in this or other embodiments one or more vortex generators of the plurality of vortex generators are one of triangular or rectangular in shape.

Additionally or alternatively, in this or other embodiments the plurality of vortex generators are positioned at a nonzero angle of attack relative to a general direction of an airflow across the heat exchanger.

Additionally or alternatively, in this or other embodiments the angle of attack is between 5 degrees and 70 degrees.

Additionally or alternatively, in this or other embodiments a ratio of a vortex generator height from the fin surface to a span between adjacent fins of the plurality of fins is between 0.01 and 1.

Additionally or alternatively, in this or other embodiments the vortex generator has an aspect ratio of streamwise length to height from the fin surface greater than 1.

Additionally or alternatively, in this or other embodiments an upstream most end of the vortex generator is upstream from an associated tube of the plurality of heat exchange tubes.

Additionally or alternatively, in this or other embodiments the plurality of heat exchange tubes are arranged in a plurality of streamwise-extending rows.

Additionally or alternatively, in this or other embodiments the vortex generators are positioned at alternating heat exchange tubes of each streamwise-extending row.

Additionally or alternatively, in this or other embodiments the vortex generators are positioned at only an upstreammost heat exchange tube of a streamwise-extending row of the plurality of streamwise-extending rows.

Additionally or alternatively, in this or other embodiments the heat exchanger is an evaporator.

In another embodiment, a heating, ventilation, air conditioning and refrigeration (HVAC&R) system includes a compressor, a condenser fluidly connected to the compressor, and an evaporator fluidly connected to the compressor and the condenser. One or more of the evaporator or the condenser are configured as a tube and fin heat exchanger and include a plurality of heat exchange tubes configured for flowing a refrigerant therethrough, a plurality of fins located such that the plurality of heat exchange tubes pass through a plurality of tube openings in the plurality of fins, and a plurality of vortex generators extending from a fin surface of the plurality of fins. The plurality of vortex generators are arranged to define nozzle like passages at the heat exchange tubes.

Additionally or alternatively, in this or other embodiments one or more vortex generators of the plurality of vortex generators are one of triangular or rectangular in shape.

Additionally or alternatively, in this or other embodiments the plurality of vortex generators are positioned at a nonzero angle of attack relative to a general direction of an airflow across the tube and fin heat exchanger.

Additionally or alternatively, in this or other embodiments the angle of attack is between 5 degrees and 70 degrees.

Additionally or alternatively, in this or other embodiments a ratio of a vortex generator height from the fin surface to a span between adjacent fins of the plurality of fins is between 0.01 and 1.

Additionally or alternatively, in this or other embodiments the vortex generator has an aspect ratio of streamwise length to height from the fin surface greater than 1.

Additionally or alternatively, in this or other embodiments an upstream most end of the vortex generator is upstream from an associated tube of the plurality of heat exchange tubes.

Additionally or alternatively, in this or other embodiments the plurality of heat exchange tubes are arranged in a plurality of streamwise-extending rows.

Additionally or alternatively, in this or other embodiments vortex generators are located at alternating heat exchange tubes of each streamwise-extending row.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
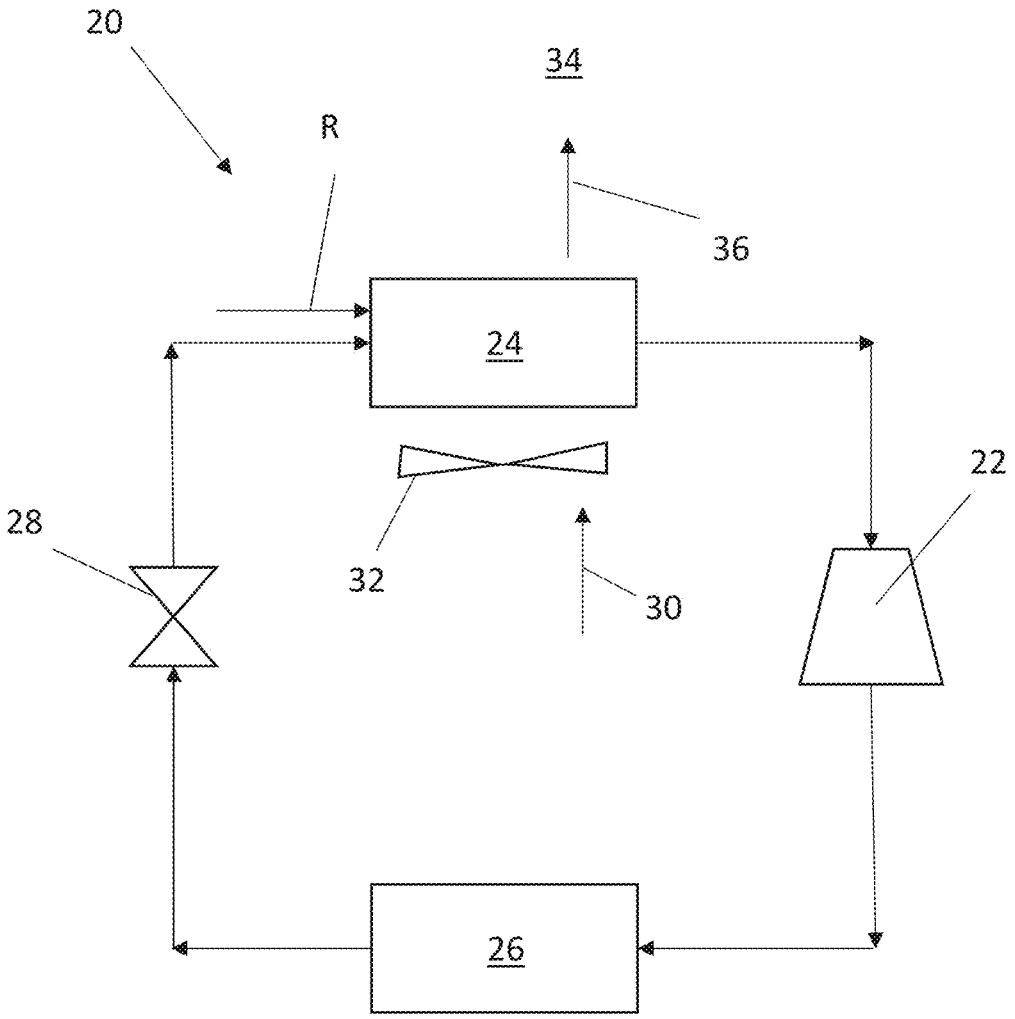
FIG. 1 is a schematic view of an embodiment of a vapor compression cycle.

Referring now to FIG. 1, a vapor compression refrigerant cycle 20 of a heating, ventilation, air conditioning, and refrigeration (HVAC&R) system is schematically illustrated. Exemplary HVAC&R systems include, but are not limited to, split, packaged, chiller, rooftop, supermarket, and transport HVAC&R systems, for example. A refrigerant R is configured to circulate through the vapor compression cycle 20 such that the refrigerant R absorbs heat when evaporated at a low temperature and pressure and releases heat when condensed at a higher temperature and pressure.

Within this vapor compression refrigerant cycle 20, the refrigerant flows in a counterclockwise direction as indicated by the arrow. The compressor 22 receives refrigerant vapor from the evaporator 24 and compresses it to a higher temperature and pressure, with the relatively hot vapor then passing to the condenser 26 where it is cooled and condensed to a liquid state by a heat exchange relationship with a cooling medium (not shown) such as air. The liquid refrigerant R then passes from the condenser 26 to an expansion device 28, wherein the refrigerant R is expanded to a low temperature two-phase liquid/vapor state as it passes to the evaporator 24. At the evaporator 24 a flow or relatively warm return air 30 is urged across the evaporator 24 by, for example, an evaporator fan 32. The return air 30 is cooled via thermal energy exchange with the refrigerant R flowing through the evaporator 24, and is flowed to a conditioned space 34, such as a room or refrigerated case, as supply air 36. The low pressure refrigerant vapor then returns to the compressor 22 where the cycle is repeated.

Figure 2:
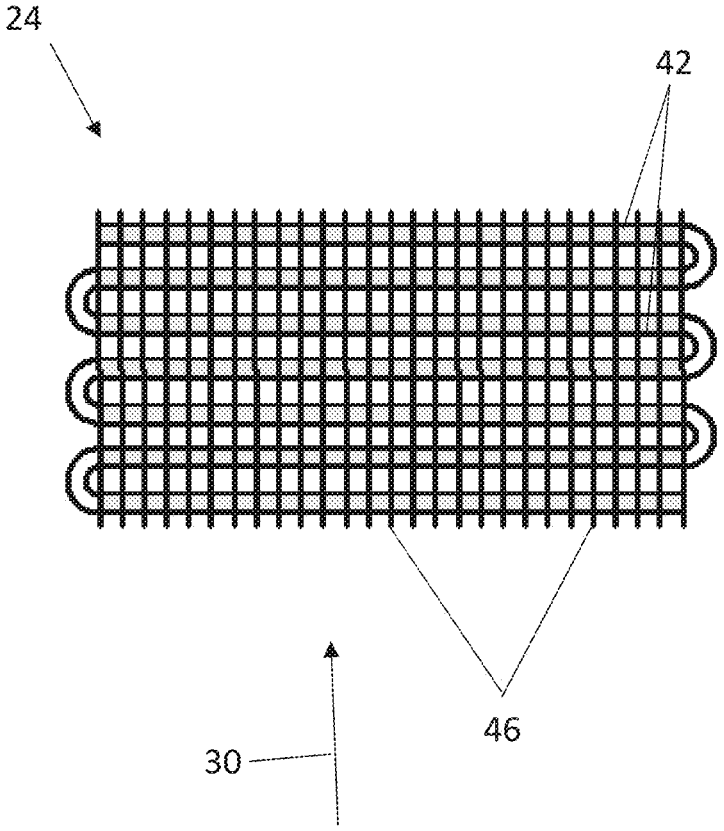
FIG. 2 is a schematic illustration of an embodiment of a round tube plate fin heat exchanger.

Referring now to FIG. 2, an example of an evaporator 24 configured for use in the vapor compression cycle 20 is illustrated in more detail. While the present disclosure utilizes evaporator 24 as the basis of the description herein, one skilled in the art will appreciate that the present disclosure may also be applied to condenser 26 or other heat exchangers in other systems. The exemplary evaporator 24 is a round tube plate fin heat exchanger and includes a plurality of heat exchange tubes 42. The plurality of heat exchange tubes 42 extend through tube openings 44 (shown best in FIG. 3) in a plurality of fins 46 located between the first manifold 38 and the second manifold 40. In some embodiments, each fin of the plurality of fins 46 is positioned orthogonal to the plurality of heat exchange tubes 42. Further, in some embodiments such as shown in FIG. 2, the plurality of heat exchange tubes 42 are arranged in a multi-pass configuration, passing through the plurality of fins 46 more than once. It is to be appreciated that the embodiment of FIG. 2 is merely exemplary and that other heat exchanger configurations are within the scope of the present disclosure.

Figure 3:
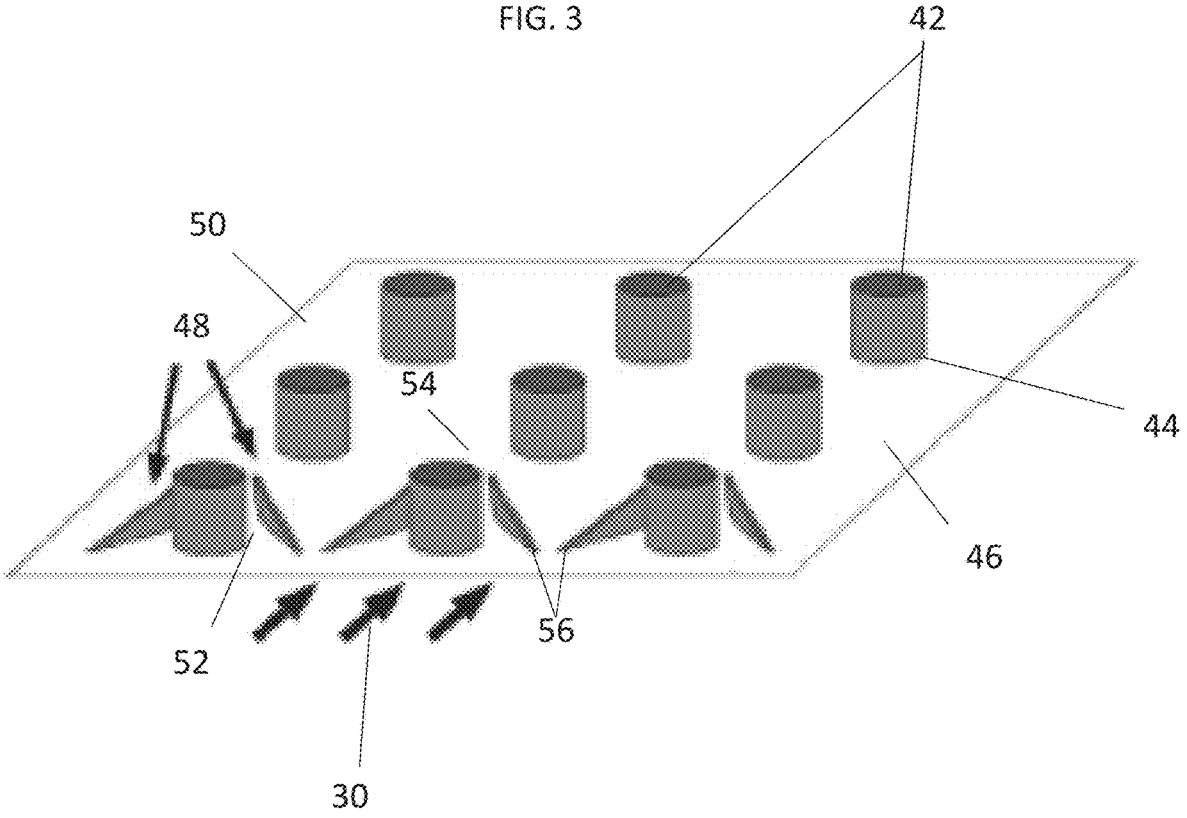
FIG. 3 is a perspective view of a tube and fin arrangement.

Referring now to FIG. 3, shown is an example of a fin 46 configuration. The plurality of heat exchange tubes 42, arranged in a plurality of streamwise rows, pass through the fin openings 44. One or more vortex generators 48 extend from a fin surface 50 and are oriented to form a nozzle-like passage 52 between the vortex generator 48 and the heat exchange tube 42. In some embodiments, the vortex generators 48 extend orthogonally from the fin surface 50. The position of the vortex generator 48 relative to the heat exchange tube 42 causes the return air 30 directed across the evaporator 24 to accelerate along the passage 52, resulting in a delayed flow separation in a tube wake region 54 downstream of the heat exchange tube 42 relative to the direction of airflow 30. The accelerated flow along the passage 52 also cause to impinge on the downstream heat exchange tube 42 tube with greater velocity resulting in enhanced convective heat transfer on the heat exchange tube 42 surface. The vortex generators 48 create streamwise longitudinal vortices that modify the boundary layer at the heat exchange tube 42 such that an air-side heat transfer coefficient is increased. Furthermore, the vortices cause enhanced mixing of the return airflow 30 and promote more uniform distribution of frost over the evaporator 24 surfaces.

Figure 4A:
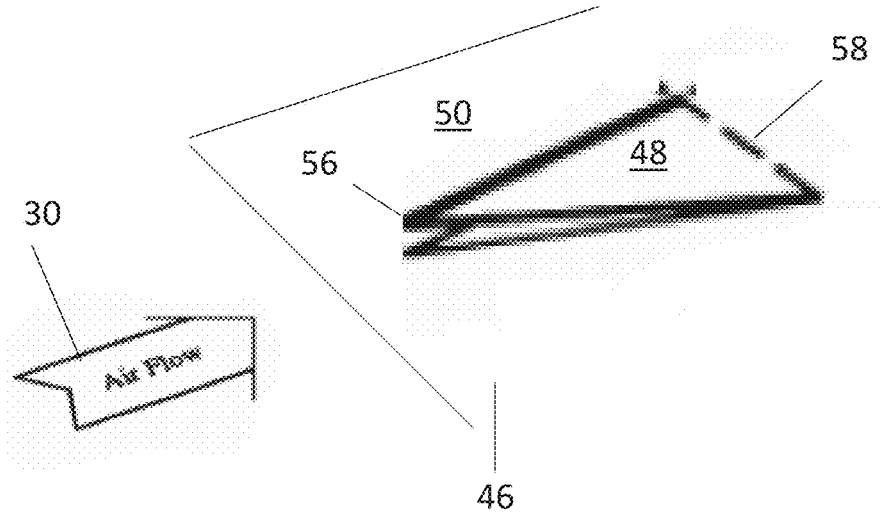
FIG. 4A-4D illustrate exemplary vortex generator shapes.
Figure 4B:
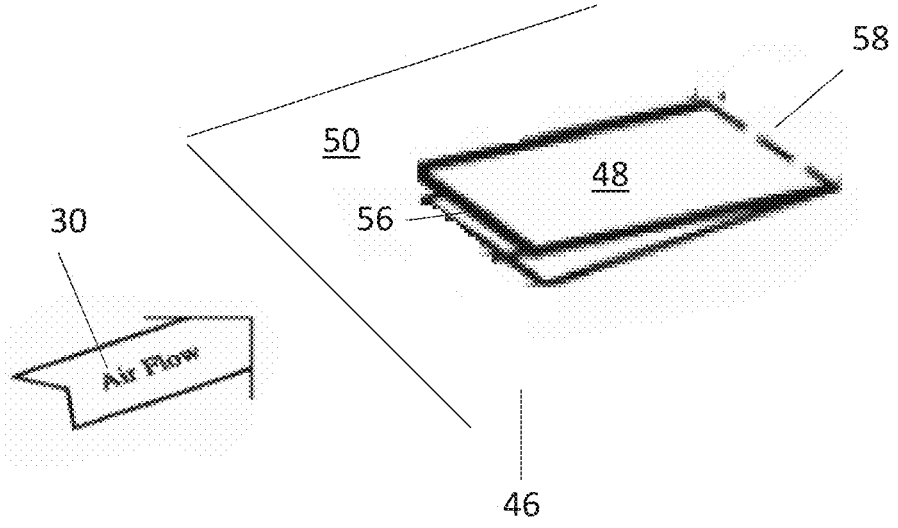
Figure 4C:
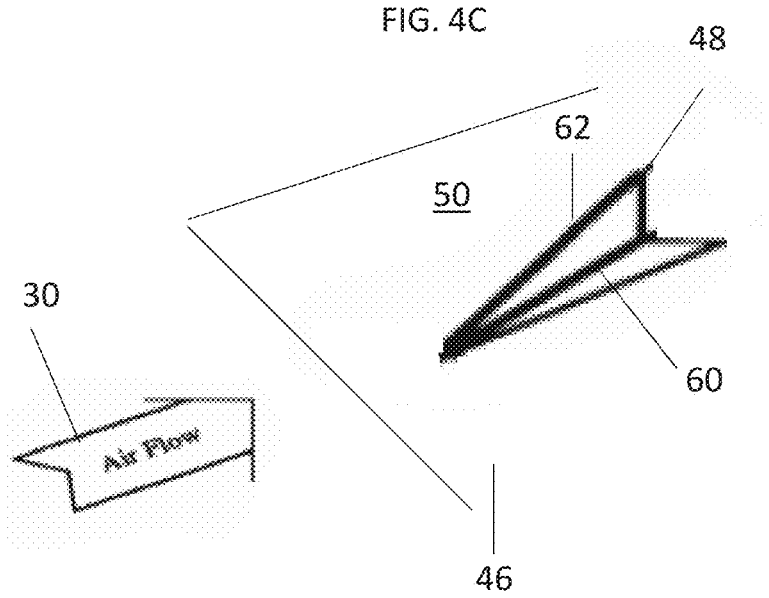
Figure 4D:
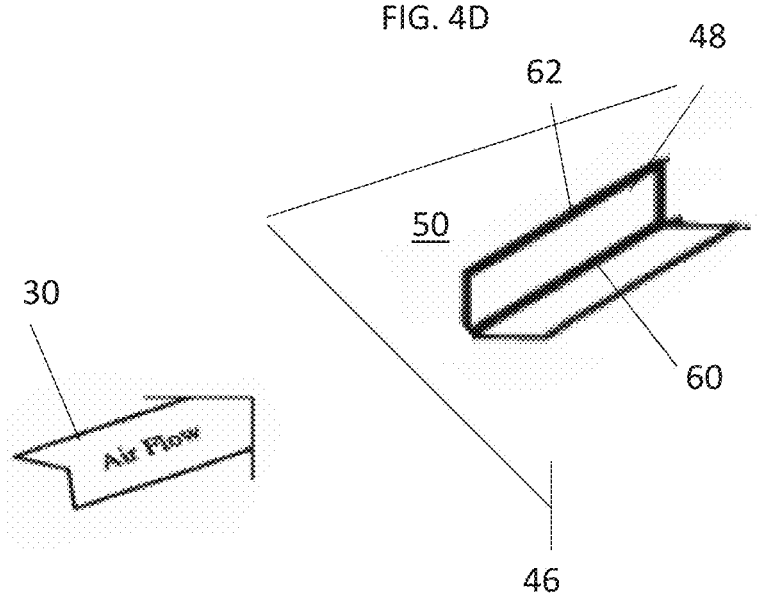

Referring to FIGS. 4A-4D, example shapes of vortex generators 48 are illustrated. In FIG. 4A, a delta wing shaped vortex generator 48 is shown, while in FIG. 4B a rectangular wing shaped vortex generator 48 is illustrated. In the configurations of FIGS. 4A and 4B, the vortex generator 48 protrudes from the fin 46 at an upstream end 56 of the vortex generator 48, while a downstream end 58 of the vortex generator 48 is fixed to the fin 46. Illustrated in FIGS. 4C and 4D are a delta winglet vortex generator 48 and a rectangular winglet vortex generator 48, respectively. In the configurations of FIGS. 4C and 4D a first lateral side 60 of the vortex generator 48 is fixed to the fin 46, while a second lateral side 62 of the vortex generator 48 protrudes from the fin surface 50. The vortex generators 48 may be formed by, for example, a punching operation of the fin 46, or alternatively may be secured to the fin 46 by brazing or adhesive application or the like.

Figure 5:
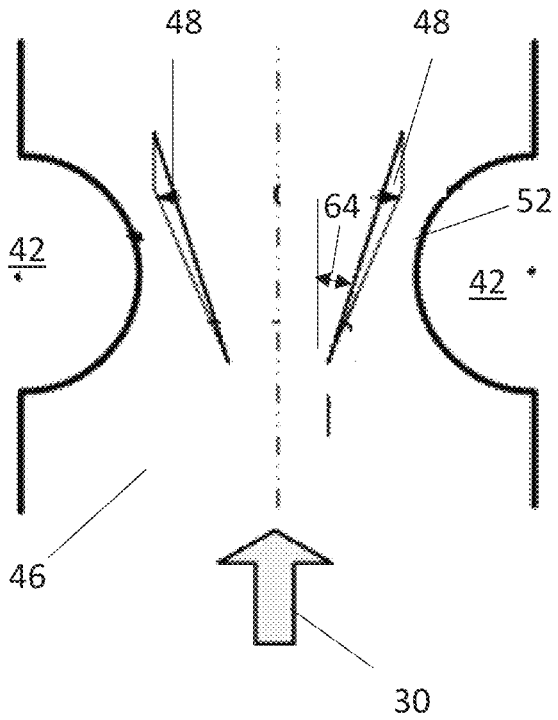
FIG. 5 is a plan view of an embodiment of a vortex generator.

Shown in FIG. 5 is a plan view of an exemplary vortex generator 48 arrangement at a heat exchange tube 42. The vortex generators 48 are arranged with a non-zero angle of attack 64, which is an angle of the vortex generator 48 relative to the flow direction of return airflow 30. In some embodiments, the angle of attack 64 is between 5 degrees and 70 degrees. The angle of attack 64 creates the nozzle-like passage 52 between the vortex generator 48 and the heat exchange tube 42. While in some embodiments, the angle of attack 64 may be equal for all of the vortex generators 48 of the evaporator 24, in other embodiments the angle of attack 64 may vary depending on characteristics of the evaporator 24.

Figure 6:
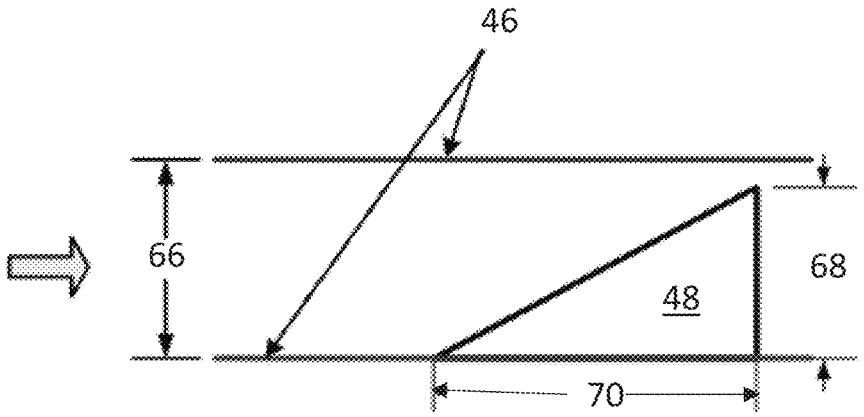
FIG. 6 is a side view of an embodiment of a vortex generator.

Referring now to the side view of FIG. 6, adjacent fins 46 are spaced by a fin span 66, which in some embodiments is between 1 millimeter and 12.7 millimeters. Further, the vortex generator 48 has a vortex generator height 68 and in some embodiments a ratio of the vortex generator height 68 to the fin span 66 is between 0.01 and 1. The vortex generator 48 further has a streamwise length 70, such that an aspect ratio of streamwise length 70 to vortex generator height 68 is greater than 1.

Referring again to FIG. 3, in some embodiments the upstream end 56 of the vortex generator 48 is located upstream of the heat exchange tube 42. In other embodiments, other arrangements may be utilized. For example, in the embodiment of FIG. 7, the upstream end 56 is located downstream of the heat exchange tube 42. IT is to be appreciated, however, that these arrangements are merely exemplary.

Figure 7:
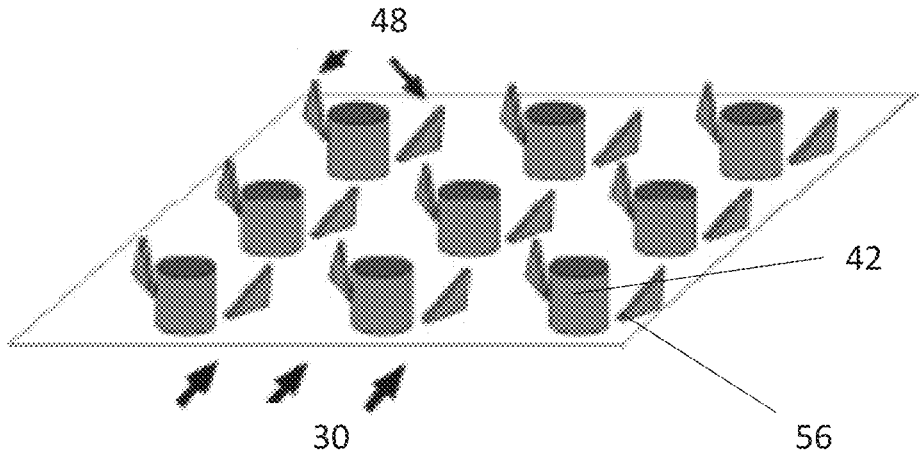
FIG. 7 is a perspective view of another tube and fin arrangement.
Figure 8:
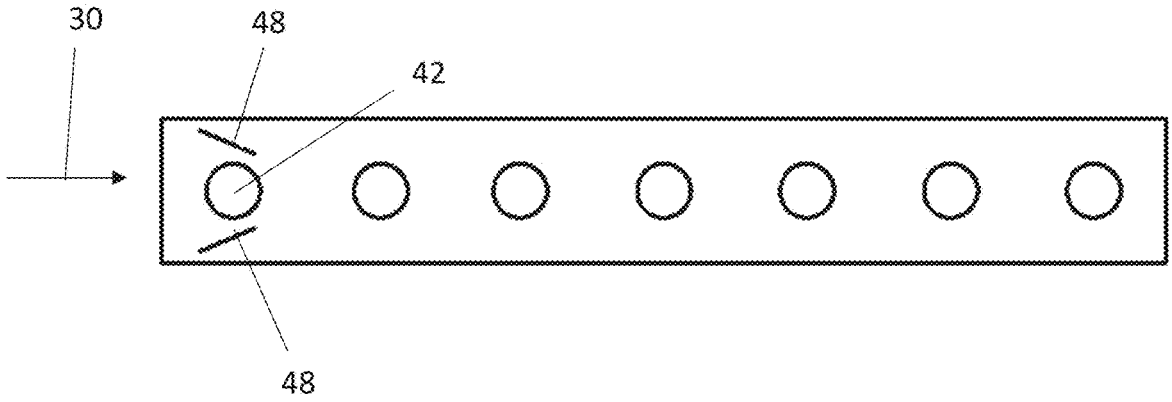
FIG. 8 is a plan view of an embodiment of a vortex generator arrangement.
Figure 9:
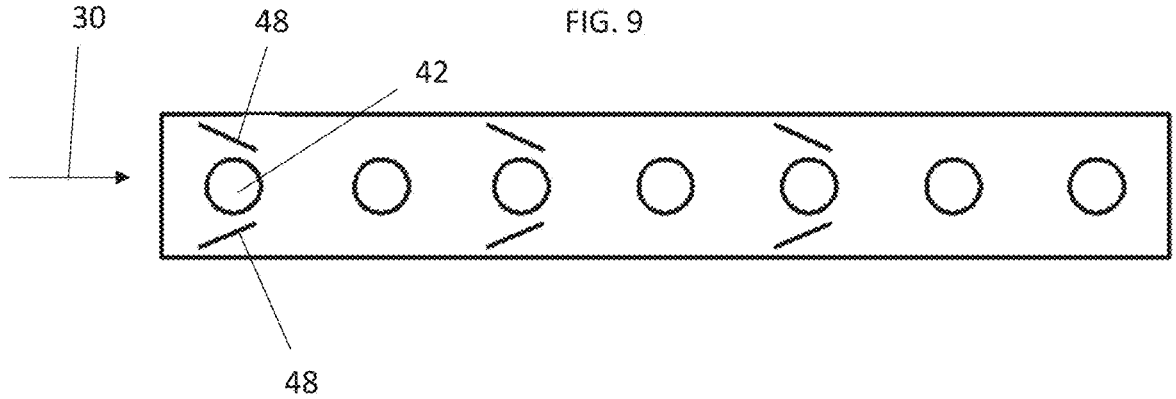
FIG. 9 is a plan view of another embodiment of a vortex generator arrangement.
Figure 10:
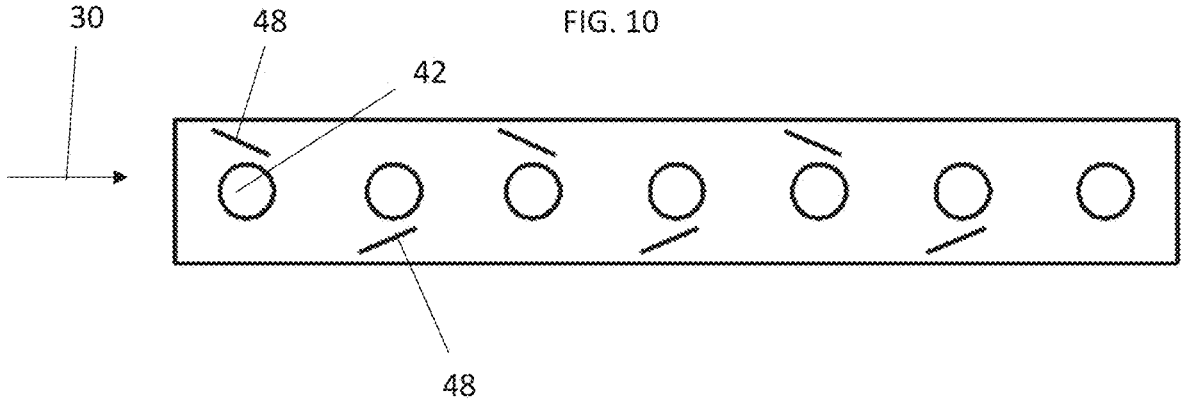
FIG. 10 is a plan view of yet another embodiment of a vortex generator arrangement.

The embodiments of FIGS. 3 and 7 illustrate configurations having two vortex generators 48 at each heat exchange tube 42 so that a nozzle like passage 52 is defined at each heat exchange tube 42. In other embodiments, as illustrated in FIGS. 8-10, other such arrangements are utilized. For example, in the embodiment of FIG. 8, the vortex generators 48 are located at only an upstream-most heat exchange tube 42 of a streamwise row of heat exchange tubes 42. As shown in FIG. 9, in another embodiment pairs vortex generators 48 are located such that heat exchange tubes 42 having vortex generators 48 alternate along a streamwise row with heat exchange tubes 42 not accompanied by vortex generators 48. Another configuration is illustrated in FIG. 10, where each heat exchange tube 48 is accompanied by a single vortex generator 48, with the location of the vortex generators 48 alternating lateral sides of the heat exchange tubes 42 along the streamwise row.

The configurations of the present disclosure improve thermal energy performance of the evaporator 24, especially in frosting configurations. The performance improvement includes a low pressure drop penalty, in a configuration that is easily and cost-efficiently manufactured. Additionally, the overall size of the heat exchanger may be reduced for the same performance as a heat exchanger without vortex generators 48.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A tube and fin heat exchanger, comprising:

a plurality of heat exchange tubes configured for flowing a refrigerant therethrough;

a plurality of fins disposed such that the plurality of heat exchange tubes pass through a plurality of tube openings in the plurality of fins; and a plurality of vortex generators extending from a fin surface of the plurality of fins, the plurality of vortex generators arranged to define nozzle like passages at the heat exchange tubes;

wherein a ratio of a vortex generator height from the fin surface to a span between adjacent fins of the plurality of fins is between 0.01 and 1.

2. The heat exchanger of claim 1, wherein one or more vortex generators of the plurality of vortex generators are one of triangular or rectangular in shape.

3. The heat exchanger of claim 1, wherein the plurality of vortex generators are disposed at a nonzero angle of attack relative to a general direction of an airflow across the heat exchanger.

4. The heat exchanger of claim 3, wherein the angle of attack is between 5 degrees and 70 degrees.

5. The heat exchanger of claim 1, wherein an upstream most end of the vortex generator is upstream from an associated tube of the plurality of heat exchange tubes.

6. The heat exchanger of claim 1, wherein the plurality of heat exchange tubes are arranged in a plurality of streamwise-extending rows.

7. The heat exchanger of claim 6, wherein vortex generators are disposed at alternating heat exchange tubes of each streamwise-extending row.

8. The heat exchanger of claim 6, wherein vortex generators are disposed at only an upstreammost heat exchange tube of a streamwise-extending row of the plurality of streamwise-extending rows.

9. The heat exchanger of claim 1, wherein the heat exchanger is an evaporator.

10. A tube and fin heat exchanger, comprising:

a plurality of heat exchange tubes configured for flowing a refrigerant therethrough;

a plurality of fins disposed such that the plurality of heat exchange tubes pass through a plurality of tube openings in the plurality of fins; and a plurality of vortex generators extending from a fin surface of the plurality of fins, the plurality of vortex generators arranged to define nozzle like passages at the heat exchange tubes;

wherein the vortex generator has an aspect ratio of streamwise length to height from the fin surface greater than 1.

11. A heating, ventilation, air conditioning and refrigeration (HVAC&R) system, comprising:

a compressor;

a condenser fluidly connected to the compressor; and an evaporator fluidly connected to the compressor and the condenser;

wherein one or more of the evaporator or the condenser are configured as a tube and fin heat exchanger, including:

a plurality of heat exchange tubes configured for flowing a refrigerant therethrough;

a plurality of fins disposed such that the plurality of heat exchange tubes pass through a plurality of tube openings in the plurality of fins; and a plurality of vortex generators extending from a fin surface of the plurality of fins, the plurality of vortex generators arranged to define nozzle like passages at the heat exchange tubes;

wherein a ratio of a vortex generator height from the fin surface to a span between adjacent fins of the plurality of fins is between 0.01 and 1.

12. The HVAC&R system of claim 11, wherein one or more vortex generators of the plurality of vortex generators are one of triangular or rectangular in shape.

13. The HVAC&R system of claim 11, wherein the plurality of vortex generators are disposed at a nonzero angle of attack relative to a general direction of an airflow across the tube and fin heat exchanger.

14. The HVAC&R system of claim 13, wherein the angle of attack is between 5 degrees and 70 degrees.

15. The HVAC&R system of claim 11, wherein the vortex generator has an aspect ratio of streamwise length to height from the fin surface greater than 1.

16. The HVAC&R system of claim 11, wherein an upstream most end of the vortex generator is upstream from an associated tube of the plurality of heat exchange tubes.

17. The HVAC&R system of claim 11, wherein the plurality of heat exchange tubes are arranged in a plurality of streamwise-extending rows.

18. The HVAC&R system of claim 11, wherein vortex generators are disposed at alternating heat exchange tubes of each streamwise-extending row.

* * * * *